United States Patent [19]

Netzer

[11] Patent Number: 4,462,015

[45] Date of Patent: Jul. 24, 1984

[54] ELECTROMAGNETIC PICK-OFF CONTROL HANDLE

[76] Inventor: Yishay Netzer, 5 Kenmar Dr., #18, Billerica, Mass. 01821

[21] Appl. No.: 345,685

[22] Filed: Feb. 4, 1982

[51] Int. Cl.[3] ..... H01F 21/06

[52] U.S. Cl. ..... 336/135; 336/30; 336/130; 336/132; 336/134

[58] Field of Search ..... 336/30, 130, 132, 133, 336/134, 135

[56] References Cited

U.S. PATENT DOCUMENTS

| | | | |
|---|---|---|---|
| 1,787,133 | 12/1930 | Wilson | 336/134 X |
| 2,790,119 | 4/1957 | Konet et al. | 336/134 X |
| 2,903,663 | 9/1959 | Collina | 336/134 |
| 3,184,651 | 5/1965 | Albosta | 336/134 X |

FOREIGN PATENT DOCUMENTS

| | | | |
|---|---|---|---|
| 1153152 | 3/1958 | France | 336/134 |

*Primary Examiner*—J. V. Truhe
*Assistant Examiner*—S. Steward
*Attorney, Agent, or Firm*—Lackenbach, Siegel, Marzullo, Presta & Aronson

[57] ABSTRACT

A joystick mechanism generates output signals corresponding to the X and Y components of a manual command. A transducer mounted in a housing includes a ferromagnetic vane member connected to the bottom of a handle extending into the housing. The transducer also includes a stator member having nine legs mounted in a 3 by 3 rectangular array. The primary winding is wound around the central leg. Two pairs of opposed secondary windings are wound around each set of three outside legs, wherein the X-axis is disposed between one pair of secondary windings and the Y-axis is disposed between the other pair of secondary windings. Primary windings may be wound around the central three legs to form a symmetrical cruciform. The handle can be fixed to a deformable top plate or be supported at a rigid top plate by a ball and socket.

4 Claims, 4 Drawing Figures

ELECTROMAGNETIC PICK-OFF CONTROL HANDLE

BACKGROUND OF THE INVENTION

1. Field of the Invention

The invention relates to man-machine interface devices and in particular to manually operated control handles.

2. Description of Prior Art

Control handles, or joysticks, are used as man-machine interface elements generating output signals in response to hand, or thumb, applied movement or force. In general, joysticks divide into two main categories: (1) position joysticks, and (2) force joysticks. The difference between the two categories is the stiffness of the handle as perceived by the operator. In the force-type joysticks, the stiffness is very high and the perceived motion is virtually zero. In position joysticks, the perceived stiffness and motion range are dependent on the particular design.

The general construction of a joystick includes a housing that is usually mounted on a panel, a handle and a position, or force, sensing mechanism. In prior art position joysticks have usually been constructed with the handle suspended in two axes by a gimbel-type mechanism, wherein each rotation axis is provided with an angular pick-off such as a potentiometer. Force-type joysticks are simpler in construction, since the handle is fixedly attached to the housing. The force-sensing mechanism is comprised of strain sensors attached to the handle and is sensitive to deflection-induced strains in two axes.

Typical joysticks are described, for example, in U.S. Pat. Nos. 4,275,611, 4,250,378, 4,156,130 and 4,107,642. A typical force-type joystick is described in U.S. Pat. No. 3,832,895.

The disadvantages of prior art position joysticks are the complicated and bulky mechanical constructions needed to support the handle and angular pick-offs in two axes. In addition, no pick-off was employed that is suitable to both force and displacement-type joystick.

SUMMARY OF THE INVENTION

An object of the invention is to provide a joystick wherein the control handle position is sensed by a non-contact electromagnetic two-axis pick-off device which has both high zero stability and simple construction.

A further object of the invention is to provide a pick-off means that is adaptible to both position and force-type joysticks.

The electromagnetic two-axes position pick-off device of the present invention comprises a primary winding for generating a time varying magnetic flux, and a transversely movable ferromagnetic vane that is connected to a manually operated handle. A group of secondary windings are magnetically coupled to the primary winding in relation to the position of the ferromagnetic vane. As a result, a sensing mechanism for a joystick is provided which has no sliding contacts and thus has a high reliability.

BRIEF DESCRIPTION OF THE DRAWINGS

The foregoing objects and the attendant advantages of the invention will become better understood by reference to the following detailed description in conjunction with the accompanying drawings wherein:

With reference to FIG. 1, the magnetic circuit of the pick-off device in accordance with the invention is shown. The magnetic circuit comprises a stator member 1, and a movable vane 2. Said stator member is machined from a block of a preferably laminated ferromagnetic material such as silicon steel or it can be sintered from a ferrite material. As shown in the figure, the stator member includes nine legs extending from a common base. The central leg 3 is wound with a primary winding 4 which is excited with an alternating current that generates magnetic flux in a magnetic circuit. The magnetic circuit includes the central leg, the eight circumferential legs, the movable vane 2 and the air gap between said vane and the stator member. When vane 2 is symmetrical with respect to the stator member 1 the magnetic flux is shared symmetrically between the circumferential legs and is substantially proportional to the amount of overlap between the vane and each of the circumferential legs. When the vane is displaced towards any of the legs the flux coupled to that particular leg will, up to a point, increase in proportion to the displacement. To measure vane 2 displacement, stator member 1 is wound with secondary windings 5, 6, 7 and 8. Windings 5 and 6 are connected in series opposition; the voltage signal in each of them is proportional to the respective magnetic flux, which is dependent on the vane displacement in the X-axis as shown in FIG. 1. The differential voltage induced in windings 5 and 6 is thus proportional to the vane displacement in the X direction and is in phase or in anti-phase with primary winding 4 voltage depending on the sense of said displacement. It is obvious that displacement of the vane in the transverse direction has substantially no effect on said output voltage since it does not affect the total flux encircled by each of windings 5 and 6. In a similar fashion displacement of vane 2 in the Y-axis will generate a differential signal out of secondary windings 7 and 8.

The two-axis displacement transducer just described would be recognized by those skilled in the art as a variable differential transformer type of transducer. There are various signal conditioning methods that can be employed to convert its ac output voltages into dc output signals as listed for example in the "Handbook of Measurement and Control" issued by Schaevitz Engineering of Camden, N.J. When applied to joystick handle displacement, sensing the null stability is the single most important parameter, whereas, gain stability is of less importance. Accordingly, the simplest signal conditioning suitable for the present sensor is a simple diode rectification circuit as described on page 7–16 of the above reference.

The transducer may be operable from an external ac source such as 400 Hz wherein the signal conditioning is done external to it, it can, however, be dc operated by integrating the excitation source and the signal conditioning inside the housing. A commercial integrated circuit particularly suitable for this purpose is the NE5520 manufactured by Signetics Corporation in California. This particular device is operable from a dc voltage supply of 6–24 volts and provides an output dc signal.

It should be noted that the transducer just described will generate output signals even if vane 2 is centered relative to the stator and is tilted rather than moving with respect to said stator. Such tilt would change the reluctance of the magnetic paths enclosed by each of the secondary windings and the transducer is thus responsive to vane tilt as well. This property can be utilized in conjunction with the application of the transducer as a sensing element in specific designs.

Figure 1:
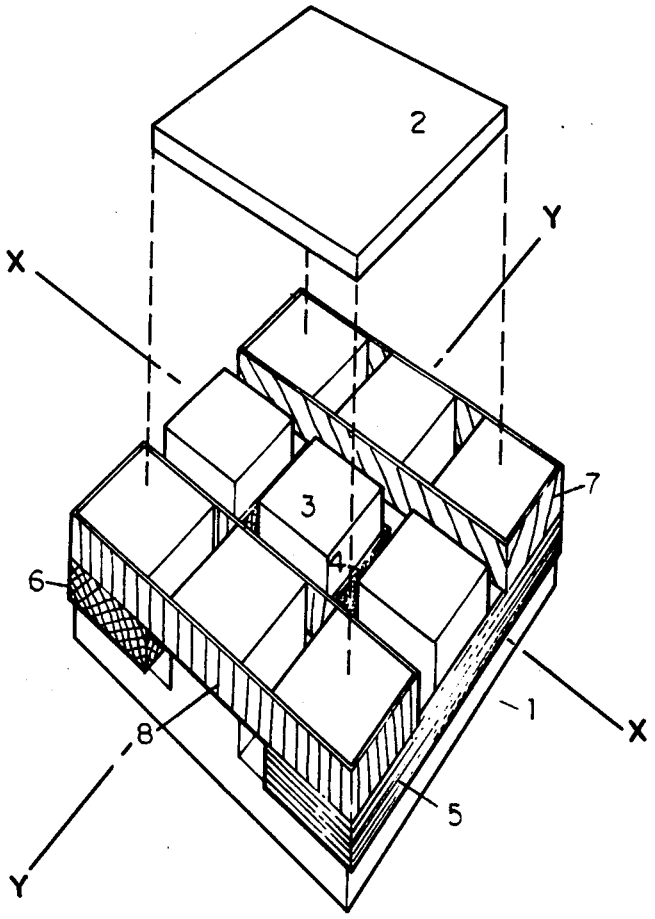
FIG. 1 is a schematic view of the preferred embodiment of the pick-off device according to the present invention.
Figure 2:
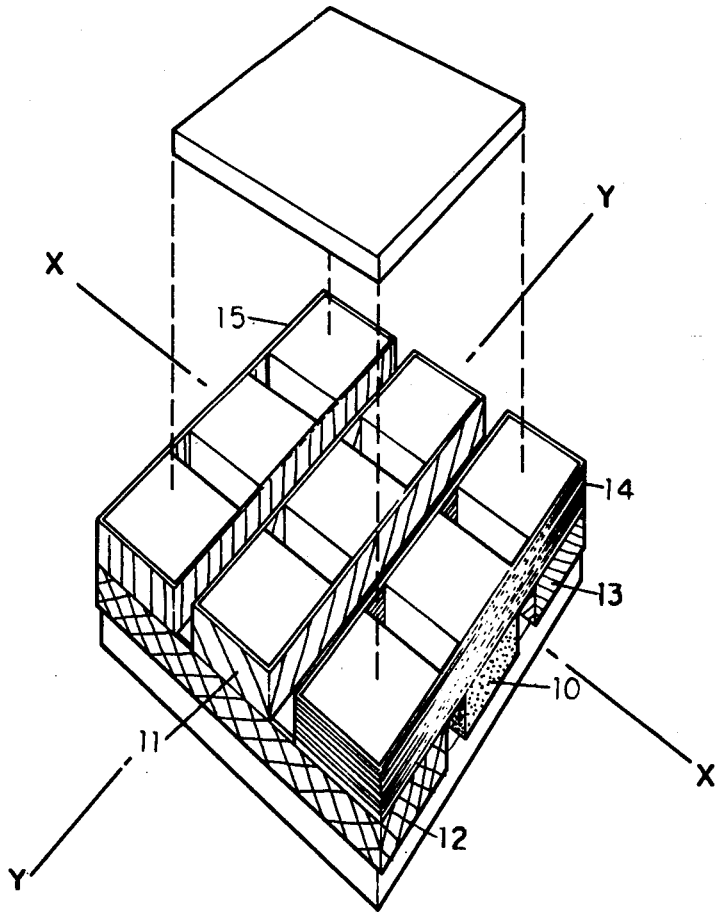
FIG. 2 shows a second method of winding the magnetic core of the pick-off device.

A different embodiment of the position transducer is shown in FIG. 2. This embodiment is identical to the one in FIG. 1 except that it is wound differently. Specifically, instead of a single primary winding there are two primary windings 10 and 11 that can be excited in parallel or in series with each other, or even seperately at two different frequencies. There are disposed a first pair of secondary windings 12 and 13 operating in conjunction with primary winding 10 and a secondary pair of windings 14 and 15 operating in conjunction with primary winding 11. The performance of the embodiment in FIG. 2 is very similar to that of the first embodiment shown in FIG. 1. The main difference is that the impedance of the primary winding is larger because of the larger cross section of the magnetic path, which can be advantageous in certain applications. Some modification to the designs in FIGS. 1 and 2 are possible. For example, the transducer can be made smaller by decreasing the cross-section of the central leg. Another modification is dispensing altogether with the four legs located in the corners.

Figure 3:
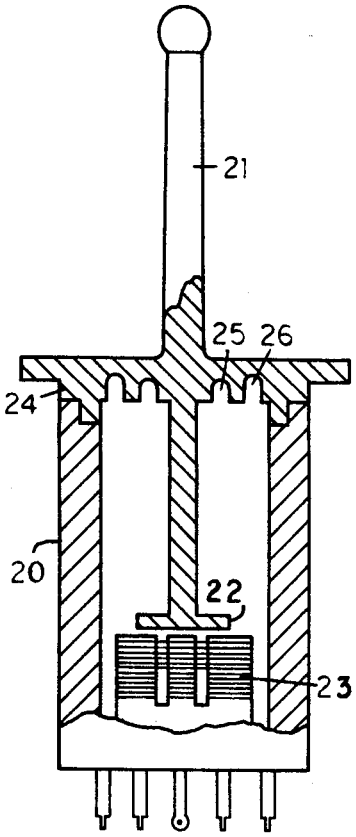
FIG. 3 is the preferred embodiment of a force-type joystick incorporating the pick-off of the present invention.

FIG. 3 shows the preferred embodiment of a force-type joystick incorporating the position transducer shown in FIG. 1 or 2. The joystick includes a housing 20, a handle 21, ferromagnetic vane 22, a position transducer stator assembly 23 and a top plate 24 mating with housing 20. Handle 21 vane 22 and the top plate 24 are machined from a single piece. Handle 21 can be shaped otherwise than in the figure so as to be thumb-operable, for example, depending upon the specific application. To make the joystick responsive to pressure applied to the handle, top plate 24 is made slightly resilient by controlling its thickness with groves 25, 26 to enable vane 22 to be displaced over the stator portion 23 of the displacement transducer and generate output signals representative of the pressure applied to the handle in the respective axes. Being a force-type joystick, the handle resilience as perceived by the operator is quite small, which means that the displacement of vane 22 is accordingly small. However, the null stability of the displacement transducer is sufficiently high such that no output signal is generated in the absence of an applied force.

Depending on the tolerance of machining the mechanical parts of the force joystick in FIG. 3, stator member 23 may have to be individually fixed to the housing so as to provide zero output signals in both axes in the absence of handle applied force. Alternatively, vane 22 could be made adjustable; however, this is less desirable since vane 22, handle 21 and top plate 24 are advantageously combined into a single part turned from a single piece of magnetic alloy. It should be mentioned that because of the small displacement of the vane during operation, it may have a circular cross-section without impairing the performance, thus simplifying the manufacturing process. The stator assembly is preferably machined from a continuous or laminated magnetic alloy and is fixed to the housing by an adhesive so as to provide a nominal zero output signal as described above.

Figure 4:
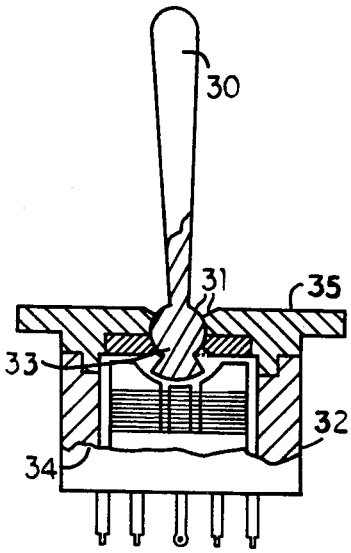
FIG. 4 is the preferred embodiment of a position-type joystick incorporating the pick-off of the present invention.

A position-type joystick of the present invention, shown in FIG. 4, comprises a handle 30, a support mechanism 31, a housing 32, a vane 33, a stator member 34 of the position transducer and a mounting top plate 35. The basic operation of the joystick is similar to that of the force joystick in FIG. 3 except that the deflection of the handle is more substantial. To accommodate for the increased displacement of vane 33 relative to stator 34 and still maintain a relatively narrow air gap, the top end of stator 34 is made concave whereas the bottom end of vane 33 is made convex, the center of curvature substantially coinciding with the center of rotation of handle 30. In the preferred embodiment of FIG. 4, the support mechanism of the handle is of the ball-and-socket type that may include a means for preventing the handle from rotating around its axis of symmetry. The displacement joystick may optionally include a means that restores the handle to its center or null position when not deflected by the operator, such as a spring. Any deflection of the handle from its null position would compress the spring to generate a restoring force proportional to the amount of deflection.

A simple high performance joystick has been described. Obviously many modifications and variations of the embodiments described are possible in the light of the above teachings. It is therefore understood that within the scope of the disclosed inventive concept, the invention may be practiced otherwise than specifically described.

I claim:

1. A joystick mechanism generating output signals corresponding to the X and Y components of manual command, comprising, in combination;

a handle controllable by an operator and rotatable in X and Y axes, a housing with a top plate, wherein said top plate includes means supporting said handle, a transducer for sensing the displacement of said handle relative to said housing, said transducer comprising a ferromagnetic vane member attached to the bottom side of said handle and a stator member attached to the bottom side of said housing, said stator member including a ferromagnetic core comprising nine parallel legs extending from a common base disposed in a 3 by 3 rectangular array wherein the edges of said array are parallel to said X and Y axes; at least one electrically excited primary winding wound around the leg at the center of said array; a first secondary winding wound around three legs along a first side of said array parallel to the X-axis; a second secondary winding wound around three legs along a second side of said array parallel to the X-axis; a third secondary winding wound around a third side of said array parallel to the Y-axis; and a fourth secondary winding wound around a fourth side of said array parallel to the Y-axis; wherein said first and second secondary windings define an X-axis and said third and fourth secondary windings define a Y-axis; said secondary windings being inductively coupled to said primary windings and generating voltages depending on the position of said vane member.

2. A joystick as in claim 1, wherein said at least one primary winding includes two primary windings each wound around the central three legs wherein said two primary windings constitute a symmetrical cruciform.

3. A joystick as in claim 1 wherein said handle is fixed to said top plate, and said top plate is deformable, thereby allowing handle deflection over a relatively narrow angular range.

4. A joystick as in claim 1 wherein said handle is supported at said top plate by means of a ball and socket, thereby allowing handle deflection over a relatively wide angular range.

* * * * *